US006027079A

United States Patent [19]

Santoro

[11] Patent Number: 6,027,079

[45] Date of Patent: Feb. 22, 2000

[54] HOOK TAPE SCREENING REPAIR PATCH

[76] Inventor: Charles Richard Santoro, 3 Chip Dr., Wading River, N.Y. 11792-9541

[21] Appl. No.: 09/098,008

[22] Filed: Jun. 15, 1998

[51] Int. Cl.[7] ..... B21F 27/00

[52] U.S. Cl. ..... 245/2; 24/306; 24/442

[58] Field of Search ..... 24/306, 442; 245/2

[56] References Cited

U.S. PATENT DOCUMENTS

| | | |
|---|---|---|
| 1,324,845 | 12/1919 | Osgood . |
| 1,749,755 | 3/1930 | Downer . |
| 1,792,594 | 2/1931 | Litwin . |
| 1,927,826 | 9/1933 | Friday . |
| 1,998,033 | 4/1935 | Tucker . |
| 2,241,257 | 5/1941 | Gronberg . |
| 2,272,196 | 2/1942 | Gittens . |
| 2,283,803 | 5/1942 | Gittens . |
| 2,487,830 | 11/1949 | Robbins, II . |
| 3,681,841 | 8/1972 | LeBlanc et al. . |
| 4,222,162 | 9/1980 | Levy et al. . |
| 4,760,980 | 8/1988 | Sharpe ..... 245/2 |

*Primary Examiner*—John J. Calvert
*Assistant Examiner*—Gary L. Welch

[57] ABSTRACT

The present invention relates to a method for repairing damaged screening. In use, a one part self attaching standalone hook tape patch providing for ventilation and light transmission, is installed in an overlaying interlocking relationship with the screening as to effectively overlap and patch the damage.

1 Claim, 2 Drawing Sheets

HOOK TAPE SCREENING REPAIR PATCH

BACKGROUND OF THE INVENTION

This invention relates to screening, specifically to the repair of damaged window screening.

Existing screening repair methods employ various materials and installation approaches. The most common, the metal screening patch, is generally a precut square or rectangular piece of woven wire fabric. This type of patch has two opposite edges of extended filaments that are shaped to contact screening at approximately 45-degree angles. This patch can only be cut down to size along the two remaining un-bent or non-securing edges. Thus, patch dimensions and shape are limited. Additionally, this repair method requires access to both sides of the screening, often necessitating removal of a screening frame from a window frame. The use of two hands is needed to precisely align multiple filaments along the patch edge so that the filaments can freely extend through the screening being repaired, and subsequently bent parallel to the screening to properly secure the patch. This multistep procedure must be repeated to install the opposite edge of the patch. Very often during this installation procedure, the securing filaments became bent or misshapen, making proper installation more difficult and time consuming. Sometimes fresh patches are needed for additional installation attempts.

While it is possible to apply a woven wire fabric patch onto screening without bending the filaments to secure it, this installation method usually results in the patch falling off when the window is opened or closed. If the screening is mounted in a door, the first slamming of the door usually dislodges the patch.

Another method of repair is the sewing of a fabric swatch to the screening with a threaded needle. Typically, the thread is sewn around the perimeter of the swatch. This repair approach also requires the use of two hands and access to both sides of the damaged screening, often necessitating the removal of the screening frame from a window frame. Additionally a sewing needle and thread are needed, along with the additional step and eye hand coordination required to thread the needle.

BRIEF SUMMARY OF THE INVENTION

Accordingly, my invention utilizes the ability of hook tape to easily and securely adhere to screening.

Several objects and advantages of my invention are;

(a) to provide a screening repair patch that can be installed with one hand;

(b) to provide a screening repair patch that requires access only to one side of screening;

(c) to provide a screening repair patch that requires no precise manual articulation for secure installation and which can be properly installed by a blind person;

(d) to provide a screening repair patch that can be installed or removed in a one step procedure;

(e) to provide a screening repair patch that can be installed and removed repeatedly without deformation of the patch;

(f) to provide a screening repair patch that can be properly installed in a few seconds;

(g) to provide a screening repair patch that can be secured to screening uniformly across the entire surface area of the patch, not just near the perimeter;

(h) to provide a self attaching screening repair patch requiring no additional tools for installation;

(i) to provide a self attaching screening repair patch that can be cut to any size or shape;

(j) to provide a self attaching screening repair patch with enough surface area for creative and decorative graphics or text; and (k) to provide a self attaching screening repair patch with an appropriate degree of ventilation and transparency.

Further objects and advantages of my invention will become apparent from a consideration of the drawings and ensuing description.

BRIEF DESCRIPTION OF THE SEVERAL VIEWS OF THE DRAWING

Drawing Figures

REFERENCE NUMERALS IN DRAWINGS

Thread
Knotted thread
Open area between weavings
Engagement elements orientation A
Engagement elements orientation B
Row of parallel engagement elements orientation C
Row of parallel engagement elements orientation D
Row of alternating perpendicular engagement elements
Gap created by severing crest of loops to create engagement elements.
Hole
Screening filaments
Open area of screening

DETAILED DESCRIPTION OF THE INVENTION

Description—FIGS. 1 to 5

Figure 1:
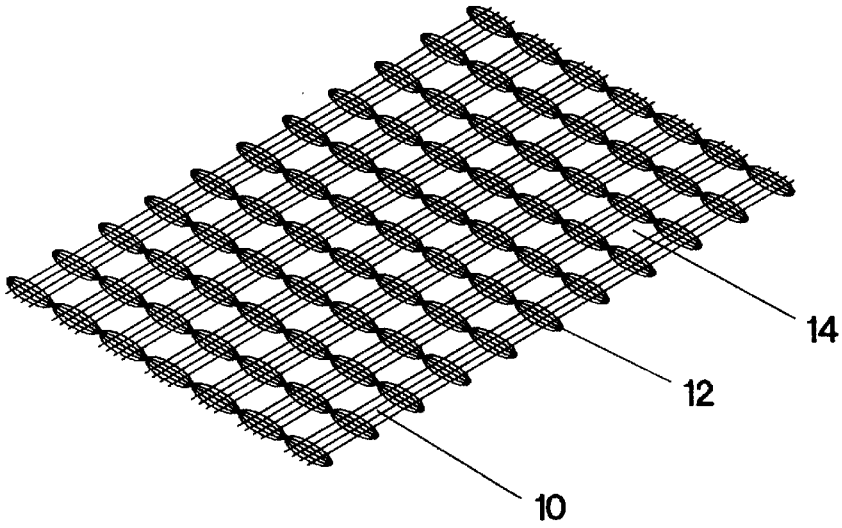
FIG. 1 is a perspective view of the non-engagement side of woven hook tape.

FIG. 1 is a perspective view of the non-engagement side of woven hook tape, available from the VELCRO® company of Manchester, N.H. as hair roller hook 262. A single strand of thread is illustrated by 10. The intersection of multiple interwoven strands form knot 12, which stabilizes the thread in a screening like shape. An open area 14, framed by thread, simulates an open area 32 of screening shown in FIG. 4.

Figure 2:
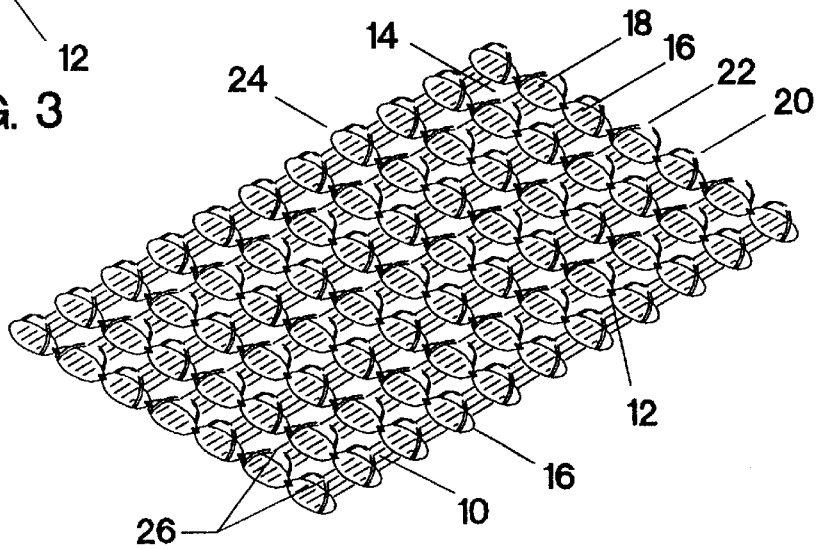
FIG. 2 is a perspective view of the engagement side of woven hook tape.

FIG. 2 is a perspective view of the engagement side of woven hook tape. The engagement elements are arranged in parallel along rows 20+22. The parallel engagement elements of 20 are oriented in a perpendicular relationship to the parallel engagement elements of row 22. This alternating parallel perpendicular pattern of engagement element rows is repeated for the full dimension of the woven hook tape. A row of engagement elements 24 in an alternating perpendicular relationship separated by knots of thread 12 is shown.

Figure 3:
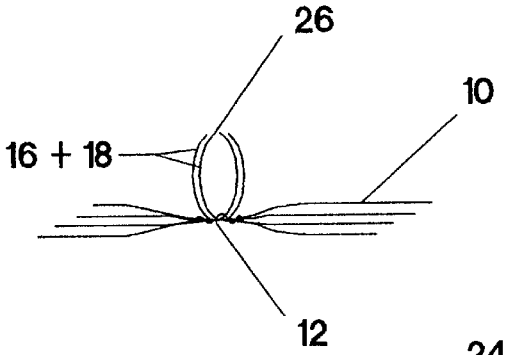
FIG. 3 is a perspective view of the engagement elements.

FIG. 3 is a perspective view of engagement elements 16+18. Thread 10 is knotted 12 at the base of the engagement elements. A gap 26 at the crest of severed thread loops separates opposite facing engagement elements.

Figure 4:
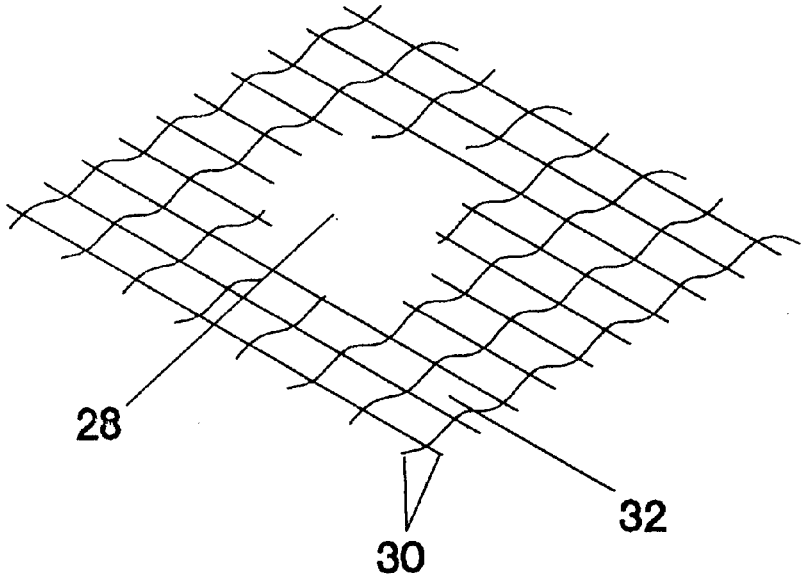
FIG. 4 is a perspective view of damaged screening.

FIG. 4 is a perspective view of screening, with a hole 28 at the center.

Figure 5:
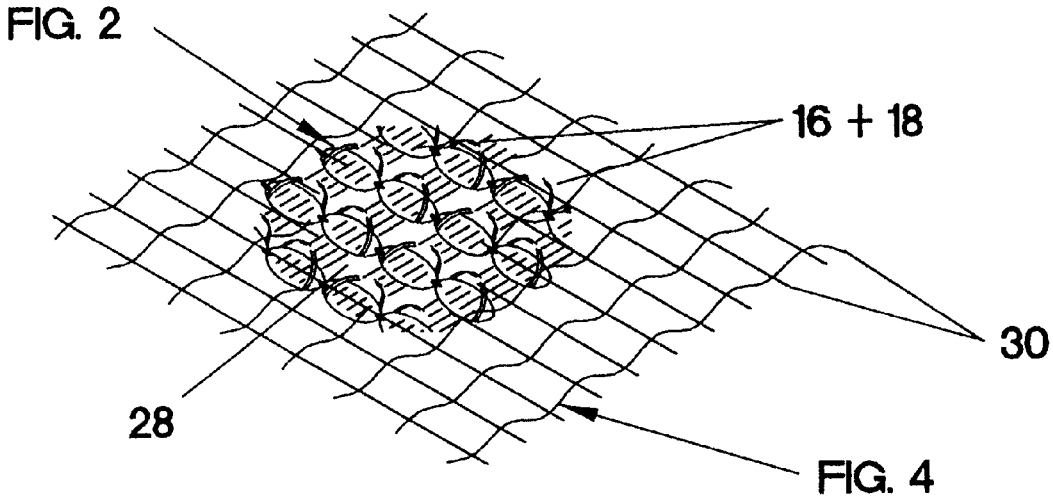
FIG. 5 is a perspective view of woven hook tape interlocked with damaged screening.

FIG. 5 is a perspective view of the engagement side of woven hook tape FIG. 2 interlocked with damaged screening FIG. 4 covering hole 28. Engagement elements 16+18 are shown grasping individual screening filaments 30.

Operation of Invention

The manner of using a hook tape patch to repair window screening differs from repairs in present use. Namely one first places a hook tape patch (FIG. 1+FIG. 2), engagement element side facing and parallel to damaged screening (FIG. 4) positioned over hole 28, utilizing either hand. Next, one manipulates the thumb of the same hand as to apply pressure to an area of the patch that is in contact with the screening. The applied pressure forces engagement elements 16+18 (FIG. 2+FIG. 3) through open areas 32 (FIG. 4), causing some to grasp the screening filaments 30 (FIG. 4).

The patch being partially attached to the screening does not require further holding in place by hand. Pressure is applied with the back of the same hand, forcing the engagement elements of the entire patch area to pass through open areas 32 (FIG. 4) of the screening, causing some but not all to grasp the screening filaments 30 (FIG. 4). Open areas 14 (FIG. 1+FIG. 2) allow for an appropriate degree of ventilation and transparency as did the original screening.

To remove the patch, one simply grasps any edge with one hand, and pulls. The patch is reusable.

CONCLUSION, RAMIFICATIONS, AND SCOPE

Accordingly, the reader will see that a hook tape screening repair patch can be used to repair screening easily, quickly and securely. Patch removal is accomplished just as easily without damage to the hook tape or screening.

Furthermore, it has the additional advantages in that it permits the installer to size or shape self attaching patches as needed;

it provides sufficient surface area for creative and decorative graphics or text;

it can be installed easily and quickly while accessing only one side of screening;

it can be reused;

it requires no tools for installation.

Although the description above contains many specificities, these should not be construed as limiting the scope of the invention but as merely providing illustrations of some of the presently preferred embodiments of this invention.

For example, a patch can be produced in any color or as any adornment such as a flower or bandage. A patch can be woven of more numerous or less numerous threads, threads can be of differing gage or composition. Engagement elements can be longer, shorter, more numerous or less numerous, etc. The patch can interlock with screening of varying gage and dimensions even if the screening is utilized in non-window environments. A non-woven hook tape patch, while not usually providing an appropriate degree of ventilation or transparency, can interlock with screening for an effective repair or adornment.

Thus the scope of the invention should be determined by the appended claims and their legal equivalents, rather than by the examples given.

I claim:

1. A method of repairing damaged screening including the steps of:

providing a fastener having engagement elements evenly disposed over one surface of the fastener;

providing ventilation means for allowing airflow and light transmission through the fastener;

sizing the fastener to be greater in dimension than the damage in the screening;

modifying the fastener to cover the damage and positioning the fastener over the damage in the screening where some engagement elements of the fastener interlock with the screening.

* * * * *